US011930895B2

(12) United States Patent
Flowers

(10) Patent No.: US 11,930,895 B2
(45) Date of Patent: Mar. 19, 2024

(54) GARMENT FOR DISPLAYING ORNAMENTS

(71) Applicant: THE BEER VEST GUYS LLC, Chicago, IL (US)

(72) Inventor: Paul Flowers, Chicago, IL (US)

(73) Assignee: The Beer Vest Guys LLC, Chicago, IL (US)

( * ) Notice: Subject to any disclaimer, the term of this patent is extended or adjusted under 35 U.S.C. 154(b) by 419 days.

(21) Appl. No.: 17/088,205

(22) Filed: Nov. 3, 2020

(65) Prior Publication Data

US 2022/0133000 A1 May 5, 2022

(51) Int. Cl.

| | |
|---|---|
| ***F16B 21/04*** | (2006.01) |
| ***A44B 1/18*** | (2006.01) |
| ***A44B 17/00*** | (2006.01) |

(52) U.S. Cl.

CPC ..... *A44B 17/0082* (2013.01); *A44B 1/18* (2013.01); *A44B 17/007* (2013.01); *A44B 17/0076* (2013.01); *Y10T 403/7007* (2015.01)

(58) Field of Classification Search

CPC ..... A44B 17/0076; A44B 17/007; A44B 17/0082; A44B 1/18; Y10T 24/13; Y10T 24/10; Y10T 403/7007; F16B 21/04

See application file for complete search history.

(56) References Cited

U.S. PATENT DOCUMENTS

| | | | | |
|---|---|---|---|---|
| 326,992 | A * | 9/1885 | Kuhn | A44B 1/32 24/109 |
| 3,142,878 | A | 8/1964 | Santora | |
| 4,562,624 | A | 1/1986 | Kanzaka | |
| 4,959,890 | A | 10/1990 | Pazurek | |
| 5,367,891 | A * | 11/1994 | Furuyama | H01F 7/0263 63/3 |
| 6,892,395 | B2 | 5/2005 | Schweer | |
| 9,861,167 | B2 | 1/2018 | Shirai et al. | |
| 2007/0079486 | A1 | 4/2007 | Paik | |

(Continued)

FOREIGN PATENT DOCUMENTS

| | | |
|---|---|---|
| EP | 0 891 723 A2 | 1/1999 |

OTHER PUBLICATIONS

International Search Report & Written Opinion on PCT App. No. PCT/US2021/057769 dated Mar. 22, 2022, 10 pages.

(Continued)

*Primary Examiner* — Robert Sandy
*Assistant Examiner* — Michael S Lee
(74) *Attorney, Agent, or Firm* — Foley & Lardner LLP

(57) ABSTRACT

A garment system includes a garment, a first male connector, and a female connector. The first male connector is coupled with the garment and includes a base and a first ridge coupled with and protruding from the base. The first ridge defines an aperture and has a first ridge outer wall, a first ridge inner wall, and a first ridge central portion extending therebetween. The first ridge further includes a ramp extending from the aperture toward the base at a non-zero angle, and a shelf coupled with the ramp and defining a securing cavity. The female connector is configured to be coupled with the first male connector and includes a cap and a rim. The rim is coupled with and protrudes from the cap, and extends substantially around the cap. A tab is coupled with the rim inner wall and is sized to fit within the aperture.

11 Claims, 5 Drawing Sheets

(56) References Cited

U.S. PATENT DOCUMENTS

| | | | | |
|---|---|---|---|---|
| 2008/0060110 | A1* | 3/2008 | Schmelzer | A44B 1/32 2/69 |
| 2010/0162591 | A1* | 7/2010 | Schmelzer | A43B 3/0078 36/136 |
| 2011/0079573 | A1* | 4/2011 | Nakamura | B65D 41/0492 215/331 |
| 2014/0082900 | A1 | 3/2014 | Smith et al. | |
| 2014/0325797 | A1 | 11/2014 | Hasegawa et al. | |

OTHER PUBLICATIONS

International Preliminary Report on Patentability cited in the PCT/US2021/057769.

* cited by examiner

GARMENT FOR DISPLAYING ORNAMENTS

TECHNICAL FIELD

The present disclosure relates to devices and methods for attaching ornaments to clothing garments.

BACKGROUND

Beer festivals are popular events for members of the beer community and they take place in various locations. They offer beer lovers a unique, shared experience, but there is no standardized or generally accepted way for members of the beer community to commemorate their presence at these festivals. Members of the beer community also like to collect and trade beer bottle caps, particularly caps from special-edition beers, hard-to-find or locally brewed beers, and beers that are no longer sold.

SUMMARY

In one embodiment, a garment system includes a garment, a first male connector, and a female connector. The first male connector is coupled with the garment and includes a base and a first ridge coupled with and protruding from the base. The first ridge defines an aperture and has a first ridge outer wall, a first ridge inner wall, and a first ridge central portion extending therebetween. The first ridge further includes a ramp extending from the aperture toward the base at a non-zero angle, and a shelf coupled with the ramp and defining a securing cavity. The female connector is configured to be coupled with the first male connector and includes a cap and a rim. The rim is coupled with and protrudes from the cap, and extends substantially around the cap, the rim having a rim outer wall and a rim inner wall. A tab is coupled with the rim inner wall and is sized to fit within the aperture.

In another embodiment, a garment system includes a garment, a first male connector, and a female connector. The first male connector is coupled with the garment and includes a base and a first ridge coupled with and protruding from the base. The first ridge defines an aperture and has a first ridge outer wall, a first ridge inner wall, and a first ridge central portion extending therebetween. The first ridge further includes a ramp extending from the aperture toward the base at a non-zero angle, and a shelf coupled with the ramp and defining a securing cavity. The female connector is configured to be coupled with the first male connector and includes a cap and a rim. The rim is coupled with and protrudes from the cap, and extends substantially around the cap, the rim having a rim outer wall and a rim inner wall. A tab is coupled with the rim inner wall and is sized to fit within the aperture. An ornament includes an inner groove and an outer protrusion, where the inner groove is configured to interface with the cap to secure the female connector to the ornament.

In yet another embodiment, a garment system includes a first portion and a second portion. The first portion includes a base defining a first aperture, a pedestal coupled with and extending from the base, and a platform coupled to the pedestal. The platform includes a first tab. The second portion includes a support and a first protrusion coupled with and extending from the support, where the first protrusion is configured to fit within the first aperture. A female connector includes a receiver portion defining an opening, a first slot extending from the opening, and a cavity extending from the opening. The opening is sized to receive the platform when the first tab is aligned with the first slot, and the first slot is sized to fit within the cavity.

DETAILED DESCRIPTION

Following below are more detailed descriptions of various concepts related to, and implementations of, methods, apparatuses, and systems for attaching an ornament to a garment. The various concepts introduced above and discussed in greater detail below may be implemented in any of numerous ways, as the described concepts are not limited to any particular manner of implementation. Examples of specific implementations and applications are provided primarily for illustrative purposes.

Members of the beer community enjoy collecting and trading beer bottle caps. There is a desire for collectors to display their caps around other beer community members or at beer festivals. Collectors sometimes wear their collected caps on articles of clothing, frequently gluing the caps onto a previously owned article of clothing to create a homemade garment. The caps are often permanently attached, inhibiting trading and causing the cap or the garment to be damaged upon removal.

Implementations herein relate to a system for attaching ornaments to a garment that includes a male connector and a female connector. The male connector is configured to be attached to a garment and is further configured to be coupled with the female connector. The female connector is configured to fit within an ornament such that when the female connector is coupled with the male connector, the ornament is displayed on the garment.

The female connector includes a cap with a rim and a locking tab. The male connector is coupled with a garment and the female connector is press fit into an ornament. The tab of the female connector is then aligned with an aperture of the male connector. As the female connector is pressed onto the male connector, the locking tab slides along a ramp until it enters a securing cavity. Once the locking tab is within the securing cavity, the female connector is attached to the male connector.

The various embodiments of the system described herein provide benefits that can be applied to ornament attachment systems. The male and female connectors provide a secure and semi-permanent attachment system where the ornament can be detached from one attachment site and reattached to a different male connector at another attachment site without damaging the garment or the ornament, facilitating easier ornament substitution and trading. Furthermore, the orientation of the female connector can be modified with respect to the ornament such that the ornament is displayed properly when on the garment. Additionally, the ornament can be removed from the female connector and the male connector can be detached from the garment without any damage.

Figure 1:
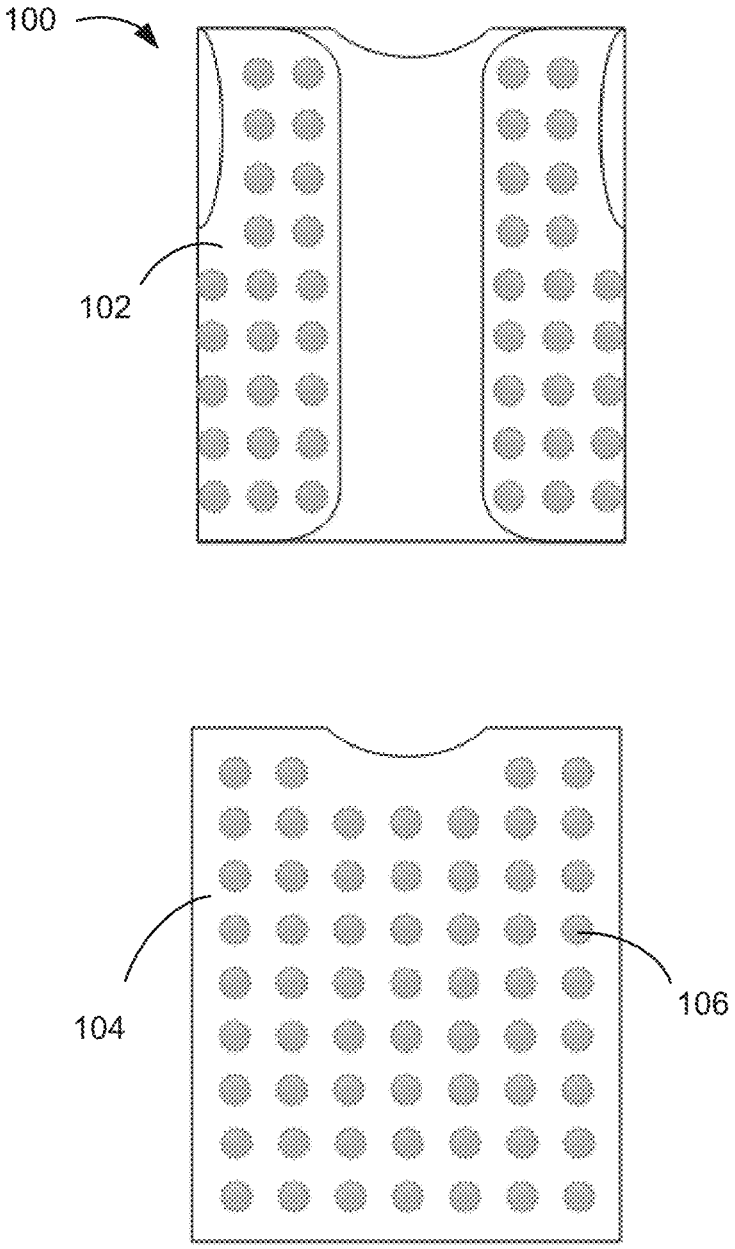
FIG. 1 is an illustration of a garment, according to a particular embodiment.

FIG. 1 is an illustration of a garment 100, according to a particular embodiment. The garment 100 includes a front portion 102, a back portion 104, and an ornament 106 coupled with the garment 100. The garment 100 may be constructed from, for example, cotton, polyester, denim, or any other material suitable for use in a garment. Though the garment 100 is shown as a vest, one of skill in the art would understand that embodiments described herein can be implemented with any other type of garment (e.g., a coat, shirt, hat, pants, etc.). Furthermore, though a specific number of ornaments 106 are shown, the garment 100 can include more or fewer ornaments 106. The ornaments 106 are shown in a specific pattern in FIG. 1; however, in various embodiments the ornaments 106 can be arranged in various patterns. For example, in some embodiments the ornaments 106 can be arranged such that the ornaments 106 form a picture (e.g., a beer bottle), symbol (e.g., a peace sign), word (e.g., "Dad"), or phrase (e.g., "Beer Rocks!"). The ornament 106 is further described with respect to FIG. 2.

Figure 2:
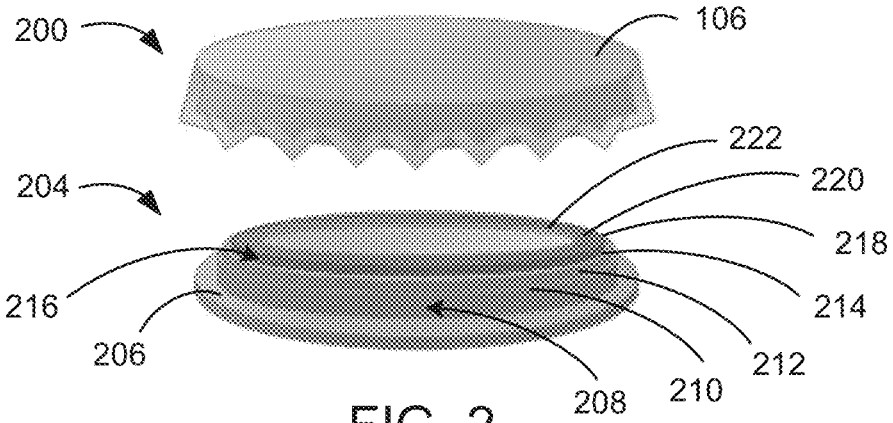
FIG. 2 is an isometric view of an ornament assembly and a male connector for attachment to the garment of FIG. 1, according to a particular embodiment.

FIG. 2 is an isometric view of an ornament assembly 200 and a male connector 204 for attachment to the garment 100 of FIG. 1, according to a particular embodiment. The ornament assembly 200 includes the ornament 106 and additional elements that are described with reference to FIGS. 3 and 5. The ornament 106 may be any type of decorative or collectible item that a user may wish to display. A non-limiting example of the ornament 106 is a bottle cap. The male connector 204 includes a base 206, an outer ridge 208, and an inner ridge 216. In some embodiments, the male connector 204 may be manufactured from a plastic material (e.g., polyethylene, polypropylene, polycarbonate, etc.). The male connector 204 may also be manufactured from metals and/or composite materials. In some embodiments, the male connector 204 is manufactured using an injection molding process; however, in various embodiments the male connector 204 can be manufactured using other manufacturing processes (e.g., machining, stamping, 3-D printing, etc.). The base 206 is substantially circular (e.g., within fifteen percent of perfectly circular) in cross-section and provides a support to which additional elements of the male connector 204 are coupled. The outer ridge 208 protrudes from and extends around the base 206. In some embodiments, the outer ridge 208 is substantially circular; however, the outer ridge 208 may be a shape that comprises only one or two axes of symmetry (e.g., oblong, elliptical, etc.). The outer ridge 208 may be continuous or formed from a series of discontinuous structures imparting the overall shape. The outer ridge 208 includes an outer ridge outer wall 210, an outer ridge inner wall 214, and an outer ridge central portion positioned therebetween. In embodiments where the outer ridge 208 is substantially circular, the outer ridge outer wall 210 defines an outer ridge outer diameter and an outer ridge outer circumference and the outer ridge inner wall 214 defines an outer ridge inner diameter and an outer ridge inner circumference. The inner ridge 216 protrudes from and extends around the base 206. The inner ridge 216 includes an inner ridge outer wall 218, an inner ridge inner wall 222, and an inner ridge central portion positioned therebetween. In embodiments where the inner ridge 216 is substantially circular, the inner ridge outer wall 218 defines an inner ridge outer circumference and an inner ridge outer diameter and the inner ridge inner wall 222 defines an inner ridge inner circumference and an inner ridge inner diameter. In some embodiments, the inner ridge outer wall 218 is contiguous with the outer ridge inner wall 214. In some embodiments, the inner ridge outer wall 218 and the outer ridge inner wall 214 may define a space therebetween. The outer ridge 208 may be continuous or formed from a series of discontinuous structures imparting the overall shape.

In some embodiments, the ornament 106 is a conventional bottle cap, where a top of the ornament 106 comprises a diameter of between approximately (e.g., plus or minus ten percent) twenty-six millimeters (mm) and thirty-six mm, and a bottom of the ornament 106 comprises a diameter of between approximately thirty-two mm and forty-two mm. An overall height of the ornament 106 is between approximately (e.g., plus or minus ten percent) 6 mm and 8 mm. Accordingly, in some embodiments the outer ridge outer wall 210 comprises a diameter smaller than the diameter of the top of the ornament 106 such that the outer ridge outer wall 210 is configured to be circumscribed by the ornament 106 when the ornament 106 is assembled to the male connector 204. In some embodiments, a height of the outer ridge 208 is greater than the height of the ornament 106 such that the ornament 106 contacts the outer ridge 208 prior to contacting the garment 100, thereby facilitating coupling of the ornament 106 to the male connector 204. The height of the inner ridge 216 may be greater than the height of the outer ridge 208 such that the ornament 106 contacts the inner ridge 216 prior to contacting the garment 100. In some embodiments, both the height of the outer ridge 108 and the inner ridge 216 are greater than the height of the ornament 106, where the height of the inner ridge 216 is greater than the height of the outer ridge 208. In such embodiments, the inner ridge 216 and the outer ridge 208 create a stepped contact with the ornament 106. For example, the inner ridge 216 may contact an underside of the top of the ornament 106, and the outer ridge 208 may contact a portion of the ornament 106 between the top of the ornament 106 and the bottom of the ornament 106.

Figure 3:
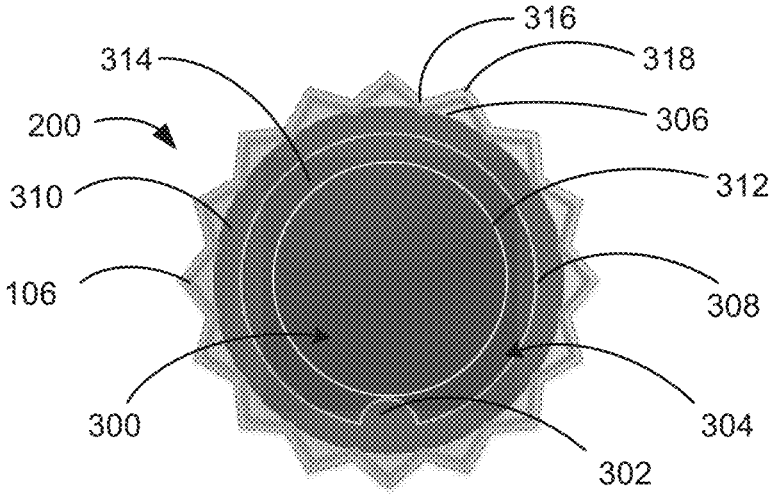
FIG. 3 is a bottom view of a female connector coupled with the ornament assembly of FIG. 2, according to a particular embodiment.

FIG. 3 is a bottom view of a female connector 300 coupled with the ornament assembly 200 of FIG. 2, according to a particular embodiment. The ornament 106 is further shown to include a corrugated portion extending substantially around the ornament 106, where the corrugated portion includes an inner groove 316 and an outer protrusion 318 defining a corrugated pattern. One of ordinary skill would understand that the spacing between the inner groove 316 and the outer protrusion 318 may be larger or smaller than shown in FIG. 3. The outer protrusion 318 and the inner groove 316 of the ornament 106 and the female connector 300 define a gap 306 positioned between the ornament 106 and the female connector 300.

The female connector 300 includes a cap 310 and a rim 304. The cap 310 is substantially circular (e.g., within fifteen percent of perfectly circular) in cross-section and provides a support to which additional elements of the female connector 300 are coupled. The cap 310 is sized and configured to fit within the ornament 106 to secure the female connector 300 to the ornament 106. In some embodiments, the cap 310 is sized such that the cap 310 contacts one or more inner grooves 316 as the cap 310 is placed in the ornament 106, and friction between the one or more inner grooves 316 prevents the female connector 300 from falling out of the ornament 106 (e.g., a press fit, interference fit, etc.). In some embodiments, the cap 310 is sized to fit within the ornament 106 without a press fit or interference fit. In such embodiments, additional mechanisms may be required to secure the cap 310 to the ornament 106. For example, the cap 310 may be secured to the ornament 106 using a permanent adhesive (glue, epoxy, etc.) or a non-permanent adhesive (e.g., tape, sticky tack, non-permanent glue, etc.). In some embodiments, the gap 306 extends below the cap 310 such that the gap 306 separates the cap 310 from the top of the ornament 106 (not shown) such that the cap 310 does not contact the top of the ornament 106. In some embodiments, a height of the cap 310 is between approximately two mm and four mm such that the cap 310 does not extend beyond the boundaries of the ornament 106. In some embodiments, a diameter of the cap 310 is between approximately twenty-five mm and thirty-five mm such that the cap 310 substantially fits within the diameter of the ornament 106.

The female connector 300 may be removed from the ornament 106 by inserting a tool into the gap 306 and at least partially under the cap 310 to pry the cap 310 from the ornament 106. The tool can be a conventional tool (e.g., a screwdriver, pry bar, etc.). The tool can also be a tool designed specifically for the purpose of removing the female connector 300 from the ornament 106. In some embodiments, the tool resembles a pry bar with a prying end formed to substantially match the shape of the gap 306 such that the tool can remove the female connector 300 from the male connector 204. Accordingly, the orientation of the female connector 300 relative to the ornament 106 can be modified by removing the female connector 300 after being coupled with the ornament 106 and repositioning the female connector 300 prior to re-coupling the female connector 300 with the ornament 106.

The rim 304 protrudes from and extends around the cap 310, and includes a rim outer wall 308 and a rim inner wall 312. In some embodiments, the rim 304 protrudes from the cap 310 between approximately two mm and four mm. Accordingly, the rim 304 does not extend beyond the boundaries of the ornament 106. The rim outer wall 308 is configured to substantially match the shape of the cap 310. In some embodiments, the rim outer wall 308 comprises a diameter that is smaller than the diameter of the cap 310. For example, the diameter of the rim outer wall 308 is approximately sixty-five percent to ninety-five percent of the diameter of the cap 310. The rim 304 may be continuous or formed from a series of discontinuous structures imparting the overall shape. A rim body 314 is positioned between the rim outer wall 308 and the rim inner wall 312. In some embodiments, the rim 314 comprises a shape that substantially matches the shape of one or more of the outer ridge 208 and the inner ridge 216. For example, the rim inner wall 312 may comprise a shape configured to interface with one or more of the outer ridge 208 and the inner ridge 216. Accordingly, the rim inner wall 312 may circumscribe the outer ridge outer wall 210 in some arrangements. The rim outer wall 308 may be circumscribed by the inner ridge inner wall 220 in some arrangements. Furthermore, the rim 304 may be configured to be positioned between the outer ridge 208 and the inner ridge 216, in some embodiments. In still other embodiments, the rim 304 is configured to contact one or more of the outer ridge 208 and the inner ridge 216 such that the rim 304 rests atop one or both of the outer ridge 208 and the inner ridge 216. The rim body 314 defines a tab 302 configured to interface with the male connector 204. The tab 302 is further described with reference to FIG. 5.

Figure 4:
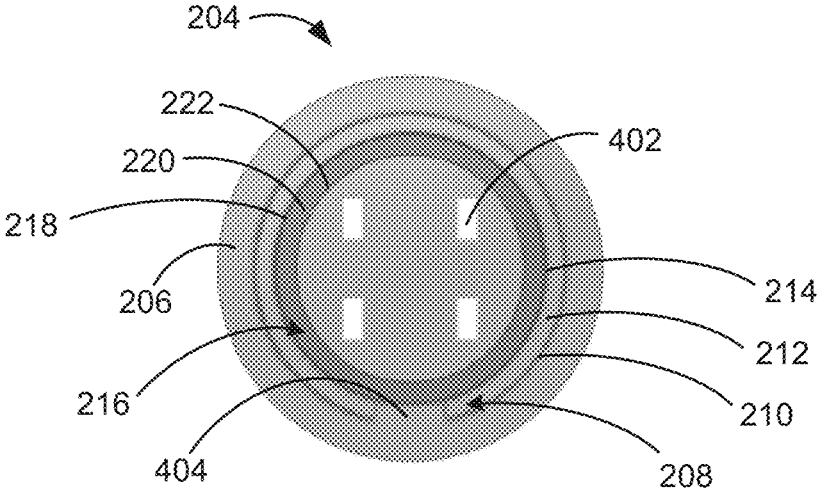
FIG. 4 is a top view of the male connector of the ornament assembly of FIG. 2, according to a particular embodiment.

FIG. 4 is a top view of the male connector 204 of FIG. 2, according to a particular embodiment. The male connector 204 is further shown to include a slot 402 defined by the base 206. In some embodiments, the base 206 defines at least two slots 402. As shown, the base 206 defines four slots 402; however, one of ordinary skill would appreciate that more or fewer slots 402 can be used. The slot 402 is sized to allow the male connector 204 to be coupled with the garment 100. In some embodiments, the male connector 204 is coupled with the garment 100 by sewing the male connector 204 to the garment 100 (e.g., thread is sewn through one or more of the slots 402 such that the male connector 204 is secured to the garment 100). In some embodiments, the garment 100 includes one or more mating components sized and configured to fit within, through, or otherwise interface with, the slots 402 to secure the male connector 204 to the garment 100. In some embodiments, the male connector 204 is secured to the garment 100 using adhesive, and the adhesive can flow through the slots 402 to secure the male connector 204 to the garment 100. In yet other embodiments, the male connector 204 does not include the slot 204. In such embodiments, the base 206 may be coupled with the garment 100 using adhesive. The base 206 may also include additional features (e.g., protrusions, bosses, ridges, etc.) to be coupled with corresponding features of the garment 100.

In some embodiments, the male connector 204 is coupled with the garment 100 using other coupling mechanisms. For example, the base 206 may include a piercing component configured to grip the garment 100 to secure the male connector 204 to the garment 100. Furthermore, the base 206 may include a threaded portion configured to interface with a corresponding portion of the garment 100. One of ordinary skill will understand that various connection mechanisms can be used to attach the male connector 204 to the garment 100.

The outer ridge 208 is shown to extend partially around the base 206 and defines an aperture 404. The aperture 404 is sized and configured to receive the tab 302 to facilitate coupling the female connector 300 with the male connector 204.

Figure 5:
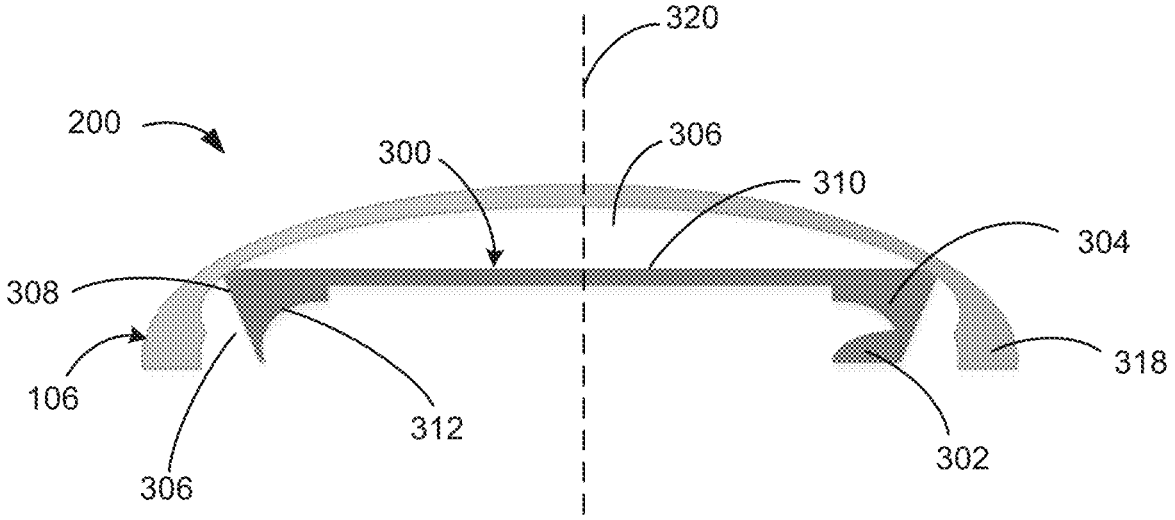
FIG. 5 is a cross-section view of the ornament assembly of FIG. 2.

FIG. 5 is a cross-sectional view of the ornament assembly 200 of FIG. 2. As shown, the rim inner wall 312 comprises a curved shape such that the rim inner wall 312 can interface with (e.g., contact, slidably receive, rotatably receive, etc.) the outer ridge 208 and/or the inner ridge 216 of the male connector 204. Though the rim inner wall 312 is shown as comprising a curved shape, one of ordinary skill would understand that the rim inner wall 312 can comprise any shape to facilitate the rim inner wall 312 interfacing with the outer ridge 208 and/or the inner ridge 216. For example, the rim inner wall 312 may comprise a substantially rectangular shape, a substantially oblong shape, or any other shape suitable for interfacing with the outer ridge 208 and/or the inner ridge 216.

The rim outer wall 308 is shown to taper toward an axis 320 extending through a center of the cap 310 as the rim outer wall 308 extends away from the cap 310. Accordingly, a diameter of a portion of the rim outer wall 308 that is substantially coplanar with the cap 310 is larger than a diameter of a portion of the rim outer wall 308 that is not coplanar with the cap 310. In some embodiments, the rim outer wall 308 is tapered at an angle of approximately two to ten degrees (e.g., an angle corresponding to a draft angle in a manufacturing process).

The tab 302 is coupled with and extends from the rim inner wall 312 toward the axis 320. As shown, the tab 302 comprises a partially oblong cross-sectional shape; however, one of skill in the art would understand that the tab 302 can comprise any cross-sectional shape configured to interface with the male connector 204 to secure the female connector 300 to the male connector 204.

Figure 6:
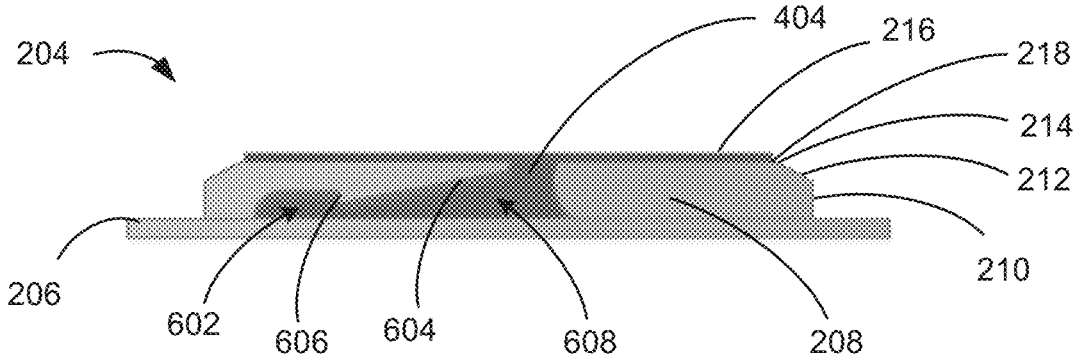
FIG. 6 is a front view of the male connector of FIG. 2.

FIG. 6 is a front view of the male connector of FIG. 2. As shown, the aperture 404 is in communication with a guide cavity 608. The guide cavity 608 is defined by the outer ridge 208, the base 206, and a ramp 604. The ramp 604 extends from a top surface of the outer ridge 208 and extends toward the base 206 at a non-zero angle. The ramp 604 is coupled with a shelf 606, which defines a securing cavity 602 that is configured to secure the tab 302.

Figure 7:
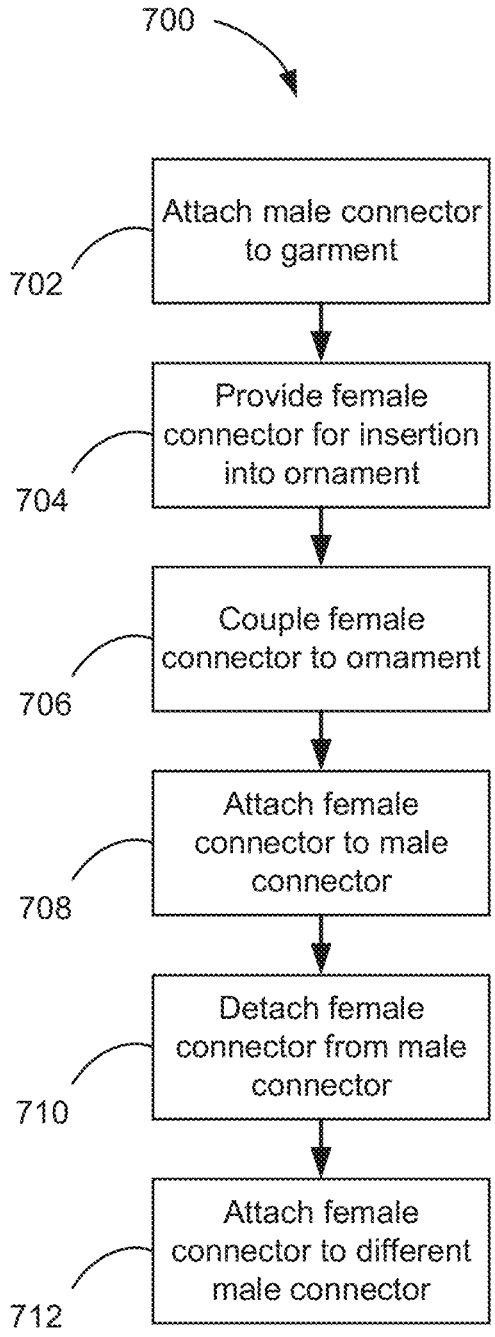
FIG. 7 is a flow diagram of a method of attaching the ornament assembly of FIG. 2 to the garment of FIG. 1, according to a particular embodiment.

FIG. 7 is a flow diagram of a method 700 of attaching the ornament assembly 200 of FIG. 2 to the garment 100 of FIG. 1, according to a particular embodiment. Accordingly, and with reference to FIGS. 1-6, at 702 the male connector 204 is attached to the garment 100. For example, the male connector 204 is attached to the garment 100 by sewing the male connector 204 to the garment 100, where thread extends from the garment 100 and through one or more of the slots 402 to secure the male connector 204 to the garment 100. In some embodiments, the male connector 204 is attached to the garment 100 using adhesive or another attachment mechanism.

The male connector 204 may be attached to the garment 100 in a specific orientation. For example, the male connector 204 may be attached to the garment 100 such that the aperture 404 faces a bottom portion of the garment 100. In some embodiments, the male connector 204 may be attached to the garment 100 such that the aperture 404 faces a top portion of the garment 100. In yet other embodiments, the male connector 204 may be attached to the garment such that the aperture 404 faces a portion of the garment 100 between the top portion and the bottom portion. In arrangements where more than one of the male connector 204 is attached to the garment 100, each of the male connectors 204 attached to the garment 100 may be attached such that the aperture 404 on each of the male connectors 204 are oriented in the same direction. Attaching the male connectors 204 as described provides for efficient manufacturing of the garment 100 and efficient assembly of the female connector 300 to the male connector 204. For example, when every male connector 204 is oriented the same way on the garment 100, a user attempting to attach a plurality of the female connector 300 to corresponding male connectors 204 does not need to determine the orientation of each of the male connectors 204 prior to, or while, attempting to couple each female connector 300 to the corresponding male connector 204.

At 704, the female connector 300 is provided for insertion into the ornament 106. For example, one or more female connectors 300 may be packaged for sale at a retailer (physical or virtual). Additionally, one or more female connectors 300 may be provided when a user purchases the garment 100. For instance, a user may purchase the garment 100, and the garment 100 may include fifty of the male connector 204. With the user's purchase, the garment 100 may be provided with fifty of the female connector 300 to be attached when desired.

At 706, the female connector 300 is coupled with the ornament 106. For example, a user may desire to display the ornament 106 on the garment 100 when attending a festival. Before displaying the ornament 106 on the garment 100, the female connector 300 must be coupled with the ornament 106. In some embodiments, the female connector 300 is coupled with the ornament 106 by pressing the female connector 300 into the ornament 106, whereby the female connector 300 is held in place via friction between the cap 310 and one or more inner grooves 316. In some embodiments, the female connector 300 is coupled with the ornament 106 by applying adhesive on or both of the cap 310 and the ornament 106 such that the components are secured when pressed together. In some embodiments, the adhesive applied is a permanent adhesive such that the female connector 300 and the ornament 106 cannot be separated once coupled. The adhesive applied may also be a non-permanent adhesive such that the female connector 300 and the ornament 106 can be separated after they are coupled.

When displaying the ornament 106 on the garment 100, the user may desire for the ornament 106 to be displayed in a certain orientation such that other individuals are able to easily read words, see images, etc (e.g., images, words, etc. should be displayed upright and not upside-down, sideways, etc.). Accordingly, the female connector 300 may include alignment indicia to assist the user in assembling the female connector 300 to the ornament 106 in the appropriate orientation. For example, the indicia may include an arrow, a line, an image, or any other type of graphic or pictorial alignment indicia. The indicia may also include written instructions to notify the user how to orient the female connector 300 with respect to the ornament 106. In an example embodiment, the indicia may include a line and wording associated with the line, where the wording notifies the user that the line should be positioned perpendicular to text, images, etc. located on the ornament 106. In another example embodiment, the indicia may include a line and wording associated with the line, where the wording notifies the user that the line should be positioned parallel to text, images, etc. located on the ornament 106. Alignment indicia may be located on one or both sides of the cap 310 such that the female connector 300 can be coupled with the ornament 106 by either pressing the female connector 300 into the ornament 106 or by pressing the ornament 106 on to the female connector 300.

At 708, the female connector 300 is attached to the male connector 204 to create the ornament assembly 200. To attach the female connector 300 to the male connector 204, the tab 302 is aligned with the aperture 404. After aligning the tab 302 with the aperture 404, the female connector 300 may be placed over the male connector 204 such that the male connector 204 is substantially enclosed by the female connector 300 and the tab is disposed in the guide cavity 608. For example, the rim inner wall 312 is disposed around the outer ridge 208. The female connector 300 is then rotated to engage the tab 302 with the ramp 604. As the female connector 300 continues to rotate, the tab 302 exerts an increasing force on the ramp 604, which may cause the ramp 604 to deflect away from the base 206. When the tab 302 reaches the shelf 606, the ramp 604 reaches its maximum deflection away from the base 206. After passing the shelf 606, the tab 302 is disposed in the securing cavity 602 and the ramp 604 returns to its original position. The securing cavity 602 and the shelf 606 prevent the tab from rotating past the shelf 606 during normal usage (e.g., wearing the garment 100, putting on and removing the garment 100, etc.), thereby maintaining the female connector 300 in a specific orientation relative to the male connector 204. In the embodiment described, the female connector 300 may be manipulated (pressed, rotated, grasped, etc.) by manipulating the ornament 106 with which the female connector 300 is coupled.

At 710, the female connector 300 is detached from the male connector 204. For example, the user may desire to change the location of the ornament 106 on the garment 100, and therefore must detach the female connector 300 from the male connector 204. To detach the female connector 300 from the male connector 204, the female connector 300 is rotated in a direction opposite the direction in which the female connector 300 is rotated to couple the female connector 300 with the male connector 204. Upon rotating the female connector 300 to detach the female connector 300 from the male connector 204, the tab 302 contacts the shelf 606. After exerting a force on the shelf that is greater than a threshold force, the tab 302 pushes the shelf 606 (and, by extension, the ramp 604) away from the base 206 until there is enough space between the shelf 606 and the base 206 for the tab 302. The threshold force may be, for example, between 0.1 and five pounds. The tab 302 then contacts the ramp 604, and as the tab 302 is rotated toward the aperture 404, the deflection of the ramp 604 decreases until the ramp 604 no longer deflects and the tab is positioned near the aperture 404. The female connector 300 is removed from the male connector 204 by pulling the female connector 300, thereby allowing the tab 302 to pass through the aperture 404.

At 712, the female connector 300 is attached to a different male connector 204. For example, the user may choose to display the ornament 106 in a different location on the garment 100, and attach the female connector 300 to a male connector 204 in the desired location. The attachment process is the same as described with respect to step 708.

The method 700 can be used to place various ornaments 106 in various locations on the garment 100. For example, the user can arrange various ornaments 106 to create a word, an image, and/or a design. In addition, the garment 100 may be provided with a plurality of the male connectors 204 in a specified arrangement such that, when the ornaments 106 are positioned on the plurality of the male attachments 204, the specified arrangement is visible.

Figure 8:
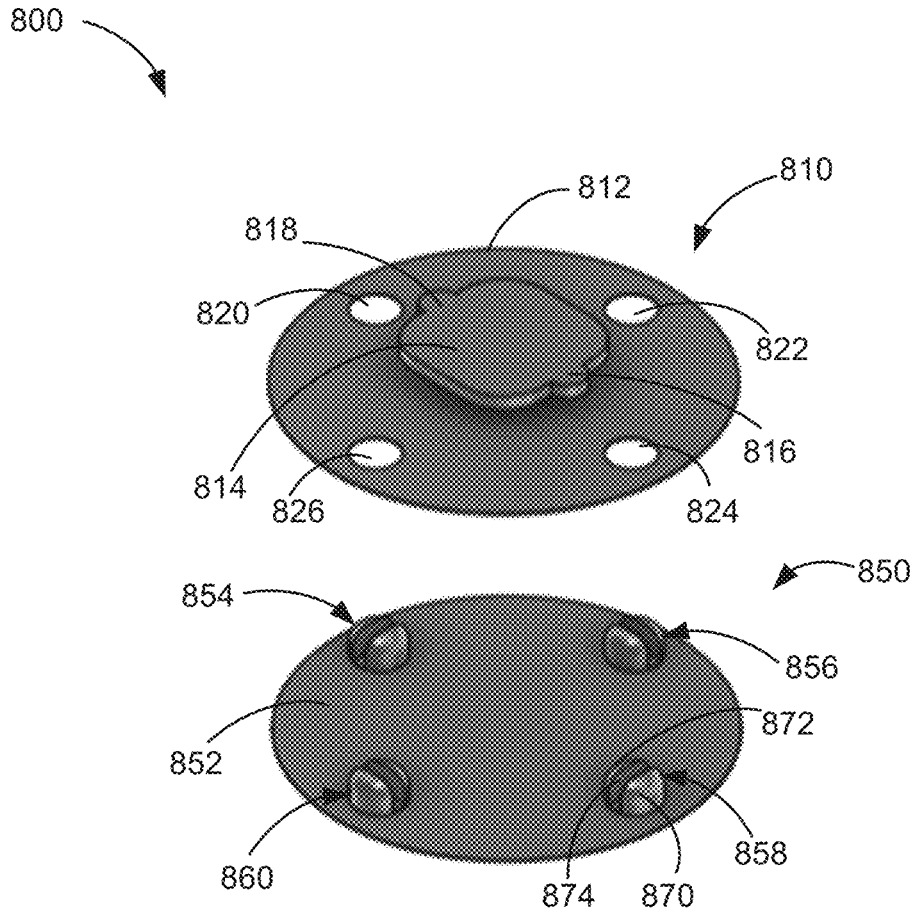
FIG. 8 is an isometric view of another embodiment of a male connector for attachment to the garment of FIG. 1.

FIG. 8 is an illustration of an isometric view of another embodiment of a male connector 800 for attachment to the garment 100 of FIG. 1. The male connector 800 includes a first portion 810 and a second portion 850. The first portion 810 includes a base 812. The base 812 is substantially circular (e.g., within fifteen percent of perfectly circular) in cross-section and provides a support to which additional elements of the first portion 810 are coupled.

A pedestal (not shown) extends from a central portion of the base 812 and couples the base 812 to a platform 814 such that the platform 814 is positioned above the base 812 but does not contact the base 812. In some embodiments, the platform 814 is positioned at a height h above the base 812. The platform 814 is substantially square shaped or rectangular shaped in cross-section, where corners of the platform 814 are rounded. The platform 814 includes a first tab 816 extending from a first side of the platform 814 and a second tab 818 extending from a second side of the platform 814. As shown, the first side and the second side are positioned opposite each other. In other embodiments, the first side and the second side may be positioned contiguously. As shown, the first tab 816 and the second tab 818 comprise a semicircular shape; however, one of skill would understand that the first tab 816 and the second tab 818 can comprise any shape. In some embodiments, the first tab 816 and the second tab 818 have substantially identical shapes. In some embodiments, the first tab 816 and the second tab 818 have shapes that differ from each other.

The base 812 is shown to define a first aperture 820, a second aperture 822, a third aperture 824, and a fourth aperture 826 (collectively referred to herein as "apertures 820-826"), where each of the apertures 820-826 extend entirely through the base 812. As shown, the apertures 820-826 are substantially circular; however, other shapes can be used. In some embodiments, the apertures 820-826 are spaced substantially equidistantly around the base 812. In some embodiments, the apertures 820-826 are positioned in other configurations.

The second portion 850 is shown to include a support 852. The support 852 is substantially circular (e.g., within fifteen percent of perfectly circular) in cross-section and provides a base to which additional elements of the second portion 850 are coupled. In some embodiments, the support 852 is substantially the same shape as the base 812. In some embodiments, the support 852 may be a different size and/or shape than the base 812.

The second portion 850 also includes a first protrusion 854, a second protrusion 856, a third protrusion 858, and a fourth protrusion 860 (collectively referred to herein as "protrusions 854-860") that extend from the second portion 850. As shown, the third protrusion 858 includes a first arm 870 and a second arm 872 positioned opposite the first arm 870. The first arm 870 and the second arm 872 define a slot 874 extending between the first arm 870 and the second arm 872. Though not individually numbered in FIG. 8, each of the protrusions 854-860 includes a first arm 870, a second arm 872, and a slot defined by the first arm 870 and the second arm 872. The first arm 870 and the second arm 872 of each of the protrusions 854-860 are sized and arranged to fit within a corresponding one of the apertures 820-826 of the first portion 810. In some embodiments, the first arm 870 and the second arm 872 are configured to deflect toward each other as each of the protrusions 854-860 contact the first portion 810 while extending through a corresponding one of the apertures 820-826. In some embodiments, the protrusions 854-860 and the apertures 820-826 are configured such that each of the protrusions 854-860 do not contact the first portion 810 as they extend through a corresponding one of the apertures 820-826. In such embodiments, an additional material (e.g., fabric) may be positioned between the first portion 810 and the second portion 850 as each of the protrusions 854-860 are inserted through a corresponding one of the apertures 820-826. The additional material contacts both the protrusions 854-860 and the first portion 810 at each of the apertures 820-826 such that the first arm 870 and the second arm 872 deflect toward each other as each of the protrusions 854-860 contact the additional material while extending through a corresponding one of the apertures 820-826. Arranged as described, the first portion 810 and the second portion 850 are configured to secure the male connector 800 to the additional material. In some embodiments, the additional material may be associated with a garment (e.g., the garment 100) such that the male connector 800 couples with the garment 100.

Figure 9:
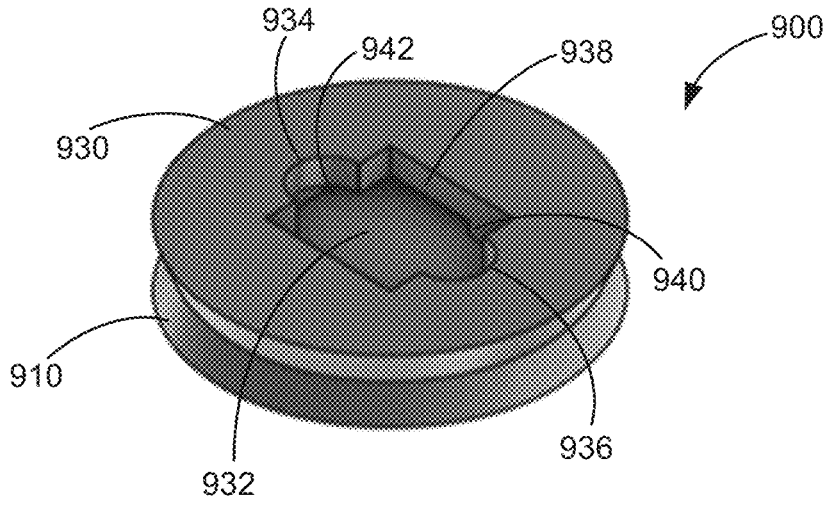
FIG. 9 is an isometric view of another embodiment of a female connector for attachment to the male connector of FIG. 8.

FIG. 9 is an illustration of an isometric view of another embodiment of a female connector 900 for attachment to the male connector 800 of FIG. 8. The female connector 900 is shown to include an insertion portion 910 and a receiver portion 930 coupled with the insertion portion.

With reference to FIG. 3, the insertion portion 910 is sized and configured to fit within the ornament 106 to secure the female connector 900 to the ornament 106. In some embodiments, the insertion portion 910 is sized such that the insertion portion 910 contacts one or more inner grooves 316 as the insertion portion 910 is placed in the ornament 106, and friction between the one or more inner grooves 316 prevents the female connector 900 from falling out of the ornament 106 (e.g., a press fit, interference fit, etc.). In some embodiments, the insertion portion 910 is sized to fit within the ornament 106 without a press fit or interference fit. In such embodiments, additional mechanisms may be required to secure the insertion portion 910 to the ornament 106. For example, the insertion portion 910 may be secured to the ornament 106 using a permanent adhesive (glue, epoxy, etc.) or a non-permanent adhesive (e.g., tape, sticky tack, non-permanent glue, etc.). In some embodiments, the gap 306 extends below the insertion portion 910 such that the gap 306 separates the insertion portion 910 from the top of the ornament 106 (not shown) such that the insertion portion 910 does not contact the top of the ornament 106. In some embodiments, a height of the insertion portion 910 is between approximately two mm and four mm such that the insertion portion 910 does not extend beyond the boundaries of the ornament 106. In some embodiments, a diameter of the insertion portion 910 is between approximately twenty-five mm and thirty-five mm such that the insertion portion 910 substantially fits within the diameter of the ornament 106.

The receiver portion 930 is configured to couple with the platform 814 of the first portion and defines an opening 932, a first slot 934, a second slot 936, a wall 938, an extension 940, and a cavity 942. The opening 932 is configured to receive the platform 814 such that the platform 814 can extend through the opening 932 when each of the first slot 934 and the second slot 936 are aligned with a corresponding one of the first tab 816 and the second tab 818. The wall 938 is sized to allow the receiver portion 900 to be rotated when coupled with the first portion 810 such that the platform 814 is received by the cavity 942. Accordingly, a height $H_1$ of the wall 938 is smaller than the height h of the pedestal, and a depth D of the cavity 942 is larger than a depth d of the platform 814. The cavity 942 extends within an inner portion of the receiver portion 930 (e.g., an undercut) such that the platform 814 can be secured by the receiver portion 930.

The extension 940 is coupled with and extends from the wall 938. A height $H_2$ of the extension 940 is larger than the height h of the pedestal such that, when the platform 814 is inserted into the opening 932, the receiver portion 930 can only be rotated in one direction. For example, upon inserting the platform 814 into the opening 932, a user may attempt to rotate the receiver portion 930 in a first direction. However, rotating in the first direction may cause the first tab 816 to contact the extension 940 and prevent the receiver portion 930 from rotating. The user may then attempt to rotate the receiver portion in a second direction opposite the first direction. Rotating in the second direction allows the first tab 816 and the second tab 818 to move within the cavity 942 such that the platform 814 is secured to the receiver portion 930.

As shown in FIGS. 8-9, the first tab 816 and the second tab 818 have the same shape and the first slot 934 and the second slot 936 have shapes corresponding to those of the first tab 816 and the second tab 818. In some embodiments, such a configuration may allow a user to couple the receiver portion with the platform 814 in two configurations. In a first configuration, the first tab 816 may be inserted into the first slot 934 and the second tab 818 may be inserted into the second slot 936. In a second configuration, the first tab 816 may be inserted into the second slot 936 and the second tab 818 may be inserted into the first slot 934. Accordingly, the receiver portion 930 may be oriented differently depending on how the platform 814 is coupled with the receiver portion 930. To avoid this occurrence, the first tab 816 and the second tab 814 may comprise different shapes. For example, the first tab 816 may be shaped as a semi-circle and the second tab may be shaped as a square. The corresponding first slot 934 may then be shaped to receive the first tab 816 and the second slot 936 may be shaped to receive the second tab 818 such that the platform 814 can only fit within the opening 932 in a single orientation.

In operation, and with reference to FIGS. 1 and 7-9, a user may desire to couple an ornament (e.g., the ornament 106) to a garment (e.g., the garment 100). To do so, the user positions the second portion 850 of the male connector 800 on an inside portion of the garment 100 (e.g., the portion of the garment not seen by another individual). The user then couples the first portion 810 with both the garment 100 and the second portion 850 by aligning the protrusions 854-860 with the apertures 820-826 and inserting the protrusions 854-860 through the apertures 820-826, thereby securing the male connector 800 to the garment 100. The user then couples the female connector 900 to the ornament 106 by inserting the insertion portion 910 into the ornament 106, as described. The receiver portion 930 is then coupled with the first portion 810 by inserting the platform 814 into the opening 932, and then rotating the receiver portion 930 to secure the female connector 900 to the male connector 800, as described.

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the term "substantially," "approximately," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided Accordingly, these terms should be interpreted as indicating that insubstantial or inconsequential modifications or alterations of the subject matter described and claimed are considered to be within the scope of the invention as recited in the appended claims.

The terms "coupled," "attached," and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the application, the scope being defined by the claims that follow. When the language a "portion" is used, the item can include a portion and/or the entire item unless specifically stated to the contrary.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Although only a few embodiments have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter described herein. For example, elements shown as integrally formed may be constructed of multiple components or elements, the position of elements may be reversed or otherwise varied, and the nature or number of discrete elements or positions may be altered or varied. The order or sequence of any method processes may be varied or resequenced according to alternative embodiments. Other substitutions, modifications, changes, and omissions may also be made in the design, operating conditions and arrangement of the various exemplary embodiments without departing from the scope of the present invention.

What is claimed is:

1. A garment system, comprising:
- a garment;
- a first male connector coupled with the garment, the first male connector comprising:
  - a base;
  - a first ridge coupled with and protruding from the base, the first ridge defining an aperture and having a first ridge outer wall, a first ridge inner wall, and a first ridge central portion extending therebetween, the first ridge further comprising:
    - a ramp extending from the aperture toward the base at a non-zero angle; and
    - a shelf coupled with the ramp and defining a securing cavity; and
  - a guide cavity defined by the ramp, the first ridge, and the base, the guide cavity in communication with the aperture and the securing cavity; and
- a female connector configured to be coupled with the first male connector, the female connector comprising:
  - a cap;
  - a rim coupled with and protruding from the cap and extending substantially around the cap, the rim having a rim outer wall and a rim inner wall; and
  - a tab coupled with the rim inner wall, the tab sized to fit within the aperture,
- wherein the securing cavity is sized to receive the tab and prevent the tab from entering the guide cavity unless the tab exerts a force on the shelf that is greater than a threshold force.

2. The garment system of claim 1, wherein when the tab is disposed in the guide cavity, as the female connector is rotated to engage the tab with the ramp, the tab exerts an increasing force on the ramp such that the ramp deflects away from the base.

3. The garment system of claim 1, wherein the base defines a first slot extending through the base.

4. The garment system of claim 1, further comprising a piercing component coupled with the base and configured to secure the first male connector to the garment.

5. A garment system, comprising:
- a garment;
- a first male connector coupled with the garment, the first male connector comprising:
  - a base; and
  - a first ridge coupled with and protruding from the base, the first ridge defining an aperture and having a first ridge outer wall, a first ridge inner wall, and a first ridge central portion extending therebetween, the first ridge further comprising:
    - a ramp extending from the aperture toward the base at a non-zero angle; and
    - a shelf coupled with the ramp and defining a securing cavity;
- a female connector configured to be coupled with the first male connector, the female connector comprising:
  - a cap;
  - a rim coupled with and protruding from the cap and extending substantially around the cap, the rim having a rim outer wall and a rim inner wall;
  - a tab coupled with the rim inner wall, the tab sized to fit within the aperture; and
- an ornament comprising an inner groove and an outer protrusion, the inner groove configured to interface with the cap to secure the female connector to the ornament,
- wherein the inner groove and the outer protrusion define a gap between the female connector and the ornament.

6. The garment system of claim 5, wherein the gap extends below a bottom surface of the cap.

7. The garment system of claim 6, wherein the gap is sized to receive a tool configured to remove the female connector from the ornament.

8. The garment system of claim 5, further comprising alignment indicia on the cap, the alignment indicia configured to orient the female connector with respect to the ornament.

9. The garment system of claim 8, wherein the alignment indicia comprises a written instruction.

10. The garment system of claim 8, wherein the alignment indicia comprises a graphic alignment indicia.

11. The garment system of claim 8, wherein the alignment indicia comprises a written instruction and a graphic alignment indicia.

* * * * *